US011566194B2

(12) United States Patent
Remondini et al.

(10) Patent No.: US 11,566,194 B2
(45) **Date of Patent: *Jan. 31, 2023**

(54) FUEL ADDITIVE COMPOSITION AND RELATED METHODS AND COMPOSITIONS

(71) Applicant: Purify Fuels, Inc., Washington, DC (US)

(72) Inventors: Stephen J. Remondini, Delray Beach, FL (US); John Carroll, Davie, FL (US); Harold H. Allen, Jr., St. Augustine, FL (US)

(73) Assignee: Purify Fuels, Inc., Washington, DC (US)

( * ) Notice: Subject to any disclaimer, the term of this patent is extended or adjusted under 35 U.S.C. 154(b) by 78 days.

This patent is subject to a terminal disclaimer.

(21) Appl. No.: 16/552,640

(22) Filed: Aug. 27, 2019

(65) Prior Publication Data

US 2020/0095512 A1 Mar. 26, 2020

Related U.S. Application Data

(63) Continuation of application No. 15/343,698, filed on Nov. 4, 2016, now Pat. No. 10,457,880.

(60) Provisional application No. 62/251,021, filed on Nov. 4, 2015.

(51) Int. Cl.

| | |
|---|---|
| ***C10L 1/04*** | (2006.01) |
| ***C10L 5/04*** | (2006.01) |
| ***C10L 10/04*** | (2006.01) |
| ***C10L 10/02*** | (2006.01) |
| ***C10L 1/16*** | (2006.01) |
| *C10L 1/12* | (2006.01) |
| *C10L 1/23* | (2006.01) |

(52) U.S. Cl.

CPC ..... *C10L 1/04* (2013.01); *C10L 1/1616* (2013.01); *C10L 5/04* (2013.01); *C10L 10/02* (2013.01); *C10L 10/04* (2013.01); *C10L 1/1233* (2013.01); *C10L 1/231* (2013.01); *C10L 2200/043* (2013.01); *C10L 2200/0423* (2013.01); *C10L 2200/0438* (2013.01); *C10L 2200/0446* (2013.01); *C10L 2230/04* (2013.01); *C10L 2270/026* (2013.01); *C10L 2270/04* (2013.01)

(58) Field of Classification Search

CPC ..... C10L 1/04; C10L 1/231; C10L 1/1233; C10L 5/04; C10L 10/02; C10L 10/04; C10L 1/1616; C10L 2200/043; C10L 2200/0423; C10L 2200/0438; C10L 2200/0446; C10L 2270/04; C10L 2270/026; C10L 2230/04

See application file for complete search history.

(56) References Cited

U.S. PATENT DOCUMENTS

| | | | | |
|---|---|---|---|---|
| 5,405,417 | A | 4/1995 | Cunningham | |
| 5,782,936 | A | 7/1998 | Riley | |
| 6,017,372 | A | 1/2000 | Berlowitz et al. | |
| 8,084,655 | B2 * | 12/2011 | Dindi | B01J 23/755 585/242 |
| 10,457,880 | B2 * | 10/2019 | Remondini | C10L 1/04 |
| 2003/0098261 | A1 * | 5/2003 | Bacha | C10L 1/04 208/170 |
| 2003/0116469 | A1 | 6/2003 | Hemighaus et al. | |
| 2003/0153634 | A1 | 8/2003 | Rainis et al. | |
| 2003/0154646 | A1 * | 8/2003 | Hazarika | C10L 10/04 44/321 |
| 2004/0040202 | A1 | 3/2004 | Bongart et al. | |
| 2005/0145540 | A1 | 7/2005 | O'Rear | |
| 2006/0006098 | A1 * | 1/2006 | Espinoza | C10G 63/04 208/950 |
| 2006/0194701 | A1 | 8/2006 | Gibbons | |
| 2007/0138053 | A1 | 6/2007 | Baillargeon | |
| 2007/0289897 | A1 | 12/2007 | Carey et al. | |
| 2008/0066375 | A1 | 3/2008 | Roos et al. | |
| 2009/0013591 | A1 | 1/2009 | Bradin et al. | |
| 2009/0031614 | A1 | 2/2009 | MacPherson et al. | |
| 2009/0062168 | A1 | 3/2009 | Timar et al. | |
| 2009/0320354 | A1 | 12/2009 | Kormann et al. | |
| 2011/0290702 | A1 | 12/2011 | Germaine et al. | |
| 2012/0060410 | A1 | 3/2012 | Sloan | |
| 2012/0117863 | A1 | 5/2012 | Cowdery-Corvan et al. | |
| 2014/0000156 | A1 | 1/2014 | Lee | |
| 2014/0046101 | A1 | 2/2014 | Ratnasamy et al. | |

(Continued)

FOREIGN PATENT DOCUMENTS

| | | | |
|---|---|---|---|
| EP | 0292526 | A1 | 11/1988 |
| EP | 0537931 | A1 | 4/1993 |

OTHER PUBLICATIONS

International Search Report and Written Opinion, International Application No. PCT/US16/60523, dated Jan. 19, 2017.

(Continued)

*Primary Examiner* — Ellen M McAvoy
*Assistant Examiner* — Ming Cheung Po
(74) *Attorney, Agent, or Firm* — Marshall, Gerstein & Borun LLP

(57) ABSTRACT

The disclosure relates to fuel additive compositions including heavy paraffinic distillates and lighter petroleum distillates, in particular with the heavy paraffinic distillates including a mixture of hydrotreated and/or saturated components and solvent-dewaxed and/or branched components. The disclosure further relates to fuel compositions including the fuel additive composition and a liquid or solid combustible fuel. Related methods include methods of making the fuel compositions and methods of burning the fuel compositions. The resulting fuel compositions have several improved combustion properties such as improved combustion efficiency, improved combustion energy/calorie content, reduced sulfur generation, and reduced ash generation.

16 Claims, No Drawings

(56) References Cited

U.S. PATENT DOCUMENTS

| | | | |
|---|---|---|---|
| 2014/0174980 | A1 | 6/2014 | Brown et al. |
| 2014/0182192 | A1 | 7/2014 | Brewer et al. |

OTHER PUBLICATIONS

European Patent Application No. 16863040.8, Extended European Search Report, dated Jun. 28, 2019.

* cited by examiner

FUEL ADDITIVE COMPOSITION AND RELATED METHODS AND COMPOSITIONS

CROSS REFERENCE TO RELATED APPLICATION

This application is a continuation of U.S. patent application Ser. No. 15/343,698 (filed Nov. 4, 2016), which claims priority to U.S. Provisional Application No. 62/251,021 (filed on Nov. 4, 2015), which are incorporated herein by reference in their entireties.

FIELD OF THE DISCLOSURE

The disclosure relates to fuel additive compositions including heavy paraffinic distillates and (lighter) petroleum distillates, in particular with the heavy paraffinic distillates including a mixture of hydrotreated and/or saturated components and solvent-dewaxed and/or branched components. The disclosure further relates to fuel compositions including the fuel additive composition and a liquid or solid combustible fuel. Related methods include methods of making the fuel compositions and methods of burning the fuel compositions.

BACKGROUND OF THE DISCLOSURE

Fuel additive compositions are used in combination with a fuel, and they are generally intended for use with a specific type of fuel (e.g., petroleum distillate fuel such as gasoline, diesel, jet fuel, or other heavier fuel oil, but not generally multiple types of fuels across a broad range of the petroleum distillate spectrum in component molecular weight and/or classes of hydrocarbons such as alkanes, cycloalkanes, and aromatic hydrocarbons). The fuel additive composition, when mixed with the fuel, can result in the fuel have one or more improved combustion properties such as improved combustion efficiency, improved combustion energy/calorie content, reduced sulfur generation, reduced ash generation, etc.

SUMMARY

In one aspect, the disclosure relates to a fuel additive composition comprising: (a) hydrotreated heavy paraffinic distillates (e.g., CAS 64742-54-7) present in amount ranging from 10 wt. % to 50 wt. % based on the fuel additive composition (e.g., at least 10%, 20%, 25%, 28% or 30% and/or up to 32%, 34%, 40%, or 50% by weight); (b) solvent-dewaxed heavy paraffinic distillates (e.g., CAS 64742-65-0) present in amount ranging from 10 wt. % to 50 wt. % based on the fuel additive composition (e.g., at least 10%, 25%, 30%, 34% or 35% and/or up to 39%, 40%, 41%, 45%, or 50% by weight); and (c) petroleum distillates comprising hydrocarbons (e.g., linear alkanes, branched alkanes, cycloalkanes, and aromatic hydrocarbons) having from 5 to 16 carbon atoms (e.g., at least 5, 6, or 7 carbon atoms and/or up to 12, 13, 14, 15, or 16) and present in an amount ranging from 10 wt. % to 50 wt. % based on the fuel additive composition (e.g., at least 10%, 20%, 25%, 29% or 30% and/or up to 34%, 35%, 40%, or 50% by weight). In a refinement, (i) the hydrotreated heavy paraffinic distillates are present in amount ranging from 20 wt. % to 40 wt. %; ii) the solvent-dewaxed heavy paraffinic distillates are present in amount ranging from 25 wt. % to 45 wt. %; and (iii) the petroleum distillates are present in amount ranging from 20 wt. % to 40 wt. %. In another refinement, (i) the hydrotreated heavy paraffinic distillates are present in amount ranging from 28 wt. % to 34 wt. %; (ii) the solvent-dewaxed heavy paraffinic distillates are present in amount ranging from 34 wt. % to 40 wt. %; and (iii) the petroleum distillates are present in amount ranging from 29 wt. % to 35 wt. %.

In another aspect, the disclosure relates to a fuel additive composition comprising: (a) saturated heavy paraffinic distillates comprising saturated hydrocarbons having from 20 to 50 carbon atoms or a sub-range thereof and present in amount ranging from 10 wt. % to 50 wt. % based on the fuel additive composition (e.g., at least 10%, 20%, 25%, 28% or 30% and/or up to 32%, 34%, 40%, or 50% by weight; substantially free from unsaturated paraffinic and/or aromatic hydrocarbons, such as less than 5%, 2%, 1%, or 0.1% by weight of the saturated heavy paraffinic distillates; the hydrocarbons can be within the C20-050 range, but not necessarily spanning every carbon number within the full range (i.e., spanning a sub-range thereof)); (b) branched heavy paraffinic distillates comprising branched hydrocarbons having from 20 to 50 carbon atoms or a sub-range thereof and present in amount ranging from 10 wt. % to 50 wt. % based on the fuel additive composition (e.g., at least 10%, 25%, 30%, 34% or 35% and/or up to 39%, 40%, 41%, 45%, or 50% by weight; substantially free from linear paraffinic hydrocarbons, such as less than 5%, 2%, 1%, or 0.1% by weight of the branched heavy paraffinic distillates; the hydrocarbons can be within the C20-050 range, but not necessarily spanning every carbon number within the full range (i.e., spanning a sub-range thereof)); and (c) petroleum distillates comprising hydrocarbons (e.g., linear alkanes, branched alkanes, cycloalkanes, and aromatic hydrocarbons) having from 5 to 16 carbon atoms (e.g., at least 5, 6, or 7 carbon atoms and/or up to 12, 13, 14, 15, or 16) and present in an amount ranging from 10 wt. % to 50 wt. % based on the fuel additive composition (e.g., at least 10%, 20%, 25%, 29% or 30% and/or up to 34%, 35%, 40%, or 50% by weight). In a refinement, (i) the saturated heavy paraffinic distillates are present in amount ranging from 20 wt. % to 40 wt. %; (ii) the branched heavy paraffinic distillates are present in amount ranging from 25 wt. % to 45 wt. %; and (iii) the petroleum distillates are present in amount ranging from 20 wt. % to 40 wt. %. In another refinement, (i) the saturated heavy paraffinic distillates are present in amount ranging from 28 wt. % to 34 wt. %; (ii) the branched heavy paraffinic distillates are present in amount ranging from 34 wt. % to 40 wt. %; and (iii) the petroleum distillates are present in amount ranging from 29 wt. % to 35 wt. %.

In another aspect, the disclosure relates to a fuel additive composition comprising: (a) hydrotreated heavy paraffinic distillates or saturated heavy paraffinic distillates comprising saturated hydrocarbons having from 20 to 50 carbon atoms or a sub-range thereof; (b) solvent-dewaxed heavy paraffinic distillates branched heavy paraffinic distillates comprising branched hydrocarbons having from 20 to 50 carbon atoms or a sub-range thereof; (c) petroleum distillates comprising hydrocarbons having from 5 to 16 carbon atoms; (d) (optionally) a combustion catalyst (e.g., a metallic oxide (oxidation) catalyst such as cerium oxide, for example in nanoparticle form; present as a stable dispersion fuel additive composition a corresponding fuel composition); and (e) (optionally) a cetane improver (e.g., a chemical which increases a diesel fuel's cetane number as known in the art, such as nitrates, nitroalkanes, nitrocarbonates and peroxides, in particular 2-ethylhexyl nitrate (CAS 27247-96-7). In a refinement, (i) a weight ratio of the hydrotreated or saturated heavy paraffinic distillates relative to the petroleum distillates ranges from 0.90 to 1.05 (e.g., 0.95 to 1.00); and (ii) a weight ratio of the solvent-dewaxed or branched heavy paraffinic distillates relative to the petroleum distillates ranges from 1.00 to 1.30 (e.g., 1.05 to 1.25 or 1.10 to 1.20). In another refinement, components (a), (b), and (c) are collectively present in a combined amount ranging from 5 wt. % to 40 wt. % based on the fuel additive composition (e.g., at least 5%, 10%, 15%, 20%, or 25% and/or up to 20%, 25%, 30%, or 40% by weight). In another refinement, the combustion catalyst is present in an amount ranging from 0.2 wt. % to 5 wt. % based on the fuel additive composition (e.g., at least 0.2%, 0.5%, 0.8%, or 1.2% and/or up to 1.5%, 2%, 3%, or 5% by weight). In another refinement, the cetane improver is present in an amount ranging from 30 wt. % to 90 wt. % based on the fuel additive composition (e.g., at least 30%, 40%, 50%, or 60% and/or up to 50%, 60%, 70%, 80%, or 90% by weight). In another refinement, a weight ratio of component (e) relative to components (a), (b), and (c) combined ranges from 1 to 8 (e.g., at least 1, 1.5, 2, 2.5, or 3 and/or up to 2, 3, 4, 5, 6, or 8). In another refinement, the combustion catalyst comprises cerium oxide (e.g., cerium oxide is the only combustion catalyst present). In another refinement, the combustion catalyst is in the form of nanoparticles having an average size ranging from 2 nm to 50 nm (e.g., a weight-, volume-, or number-average size such as determined by light scattering or other suitable method; at least 2, 5, 8, 10, 15, or 20 nm and/or up to 10, 15, 20, 30, 40, or 50 nm, such as 5 nm or 10 nm to 20 nm or 30 nm). In another refinement, the cetane improver comprises 2-ethylhexyl nitrate. In another refinement, the fuel additive composition further comprises one or more additives selected from the group consisting of antioxidants, antimicrobial agents, anti-static agents, and combinations thereof. In another refinement, the fuel additive composition is substantially free from alcohols. In another refinement, the fuel additive composition is substantially free from components other than components (a), (b), (c), (d), (e), antioxidants, antimicrobial agents, anti-static agents.

The fuel additive composition is generally in liquid form at room temperature (about 25° C.) and preferably at most or all operational environmental temperatures, for example as low as about −10° C., −5° C., 0° C. or 5° C. and/or up to about 40° C. The fuel additive composition can be formed by any suitable blending or mixing process of its components (e.g., stirring, agitation, high-shear mixing, ultrasonic mixing, etc.).

Various refinements of the hydrotreated or saturated heavy paraffinic distillates in the fuel additive composition are possible. In a refinement, the hydrotreated heavy paraffinic distillates or the saturated heavy paraffinic distillates have a viscosity as measured at 40° C. (e.g., by ASTM D445) ranging from 15 cSt to 60 cSt (e.g., 20 cSt to 40 cSt). For example, the hydrotreated heavy paraffinic distillates or the saturated heavy paraffinic distillates can comprise a blend of (i) low-viscosity hydrotreated or saturated heavy paraffinic distillates having a viscosity as measured at 40° C. (e.g., by ASTM D445) ranging from 15 cSt to 30 cSt (e.g., 15 cSt to 25 cSt) and (ii) high-viscosity hydrotreated or saturated heavy paraffinic distillates having a viscosity as measured at 40° C. (e.g., by ASTM D445) ranging from 30 cSt to 60 cSt (e.g., 35 cSt to 50 cSt). In another refinement, the hydrotreated heavy paraffinic distillates or the saturated heavy paraffinic distillates have a viscosity as measured at 100° C. (e.g., by ASTM D445) ranging from 3 cSt to 10 cSt (e.g., 4 cSt to 7 cSt). In another refinement, the hydrotreated heavy paraffinic distillates or the saturated heavy paraffinic distillates have a density (e.g., measured by ASTM D4052) ranging from 0.845 kg/L to 0.870 kg/L (e.g., 0.850 kg/L to 0.865 kg/L).

Various refinements of the solvent-dewaxed or branched heavy paraffinic distillates in the fuel additive composition are possible. In a refinement, the solvent-dewaxed heavy paraffinic distillates or the branched heavy paraffinic distillates have a viscosity as measured at 40° C. (e.g., by ASTM D445) ranging from 200 cSt to 600 cSt (e.g., 400 cSt to 550 cSt). In another refinement, the solvent-dewaxed heavy paraffinic distillates or the branched heavy paraffinic distillates have a viscosity as measured at 100° C. (e.g., by ASTM D445) ranging from 15 cSt to 50 cSt (e.g., 25 cSt to 40 cSt).

Various refinements of the petroleum distillates in the fuel additive composition are possible. In a refinement, the petroleum distillates comprise hydrocarbons having from 7 to 12 carbon atoms (e.g., the petroleum distillates and/or the fuel additive composition is substantially free from hydrocarbons having 5, 6, 13, 14, 15, or 16 carbon atoms, such as less than 5%, 2%, 1%, or 0.1% by weight of the petroleum distillates or fuel additive composition; for example Stoddard solvent as the petroleum distillates with about 30-50 wt. % linear and branched alkanes, about 30-40 wt. % cycloalkanes, and about 10-20 wt. % aromatic hydrocarbons). In another refinement, the petroleum distillates are selected from the group consisting of mineral spirits, mineral turpentine, petroleum spirits, naphtha, Stoddard solvent, kerosene, and combinations thereof.

Various refinements of the fuel additive composition are possible. In a refinement, the (i) a weight ratio of the hydrotreated or saturated heavy paraffinic distillates relative to the petroleum distillates ranges from 0.90 to 1.05 (e.g., 0.95 to 1.00); and (ii) a weight ratio of the solvent-dewaxed or branched heavy paraffinic distillates relative to the petroleum distillates ranges from 1.00 to 1.30 (e.g., 1.05 to 1.25 or 1.10 to 1.20). In another refinement, the fuel additive composition further comprises one or more additives selected from the group consisting of combustion catalysts (e.g., cerium-containing catalysts such as cerium oxide nanoparticles), antioxidants (e.g., 4,4'-methylenebis(2,6-di-tert-butylphenol)), antimicrobial agents, anti-static agents, and combinations thereof. In another refinement, the fuel additive composition is substantially free from alcohols (e.g., less than 5 wt. %, 2 wt. %, 1 wt. %, 0.1 wt. %, or 0.01 wt. % alcohol based on the fuel additive composition, for example total alkyl alcohols such as methanol, ethanol, propanol, butanol, isomers thereof, and mixtures thereof). In another refinement, the fuel additive composition is substantially free from components other than the hydrotreated heavy paraffinic distillates or the saturated heavy paraffinic distillates, the solvent-dewaxed heavy paraffinic distillates or the branched heavy paraffinic distillates, and the petroleum distillates (e.g., less than 5 wt. %, 2 wt. %, 1 wt. %, 0.1 wt. %, or 0.01 wt. % based on the fuel additive composition; for example where the other components include one or more of the above additives).

In another aspect, the disclosure relates to a fuel composition comprising: (a) the fuel additive composition of any of the foregoing aspects, refinements, and embodiments; and (b) a combustible fuel; wherein a weight ratio of the combustible fuel to the fuel additive composition ranges from 2 to 1000. In various refinements, the weight ratio of the combustible fuel to the fuel additive composition can be at least 2, 3, 5, 10, 15, 20, 25, 50, 100, or 200 and/or up to 5, 7, 8, 10, 15, 20, 25, 30, 40, 50, 60, 80, 100, 200, 500, 800, or 1000. In various embodiments, the weight ratio can range from 2 to 30, 2 to 20, 2 to 10, 2 to 8, 3 to 40, 3 to 25, 3 to 15, 3 to 10, 3 to 7, 5 to 50, 5 to 40, 5 to 30, 5 to 15, 10 to 60, 10 to 30, 15 to 25, 50 to 800, or 200 to 800 depending on the particular combustible fuel and the desired combustion properties for targeted improvement. In some embodiments, the combustible fuel comprises a liquid fuel. In other embodiments, the combustible fuel comprises a solid fuel (e.g., coal).

In another aspect, the disclosure relates to a fuel composition comprising: a fuel additive composition comprising (a) hydrotreated heavy paraffinic distillates or saturated heavy paraffinic distillates comprising saturated hydrocarbons having from 20 to 50 carbon atoms or a sub-range thereof; (b) solvent-dewaxed heavy paraffinic distillates branched heavy paraffinic distillates comprising branched hydrocarbons having from 20 to 50 carbon atoms or a sub-range thereof; (c) petroleum distillates comprising hydrocarbons having from 5 to 16 carbon atoms; (d) a combustion catalyst; and (e) a cetane improver; and combustible fuel (e.g., a fuel oil, diesel fuel, biodiesel fuel); wherein: (i) a weight ratio of the combustible fuel to the fuel additive composition ranges from 2 to 1000; (ii) components (a), (b), and (c) of the fuel additive composition are collectively present in a combined amount ranging from 10 ppm to 5000 ppm by weight based on the fuel composition (e.g., at least 10, 20, 50, 100, 200, or 500 ppm and/or up to 200, 500, 1000, 2000, 5000, or 10000 ppm by weight); (iii) the combustion catalyst is present in an amount ranging from 2 ppm to 100 ppm by weight based on the fuel composition (e.g., at least 2, 5, 10, 15, or 20 ppm and/or up to 15, 20, 25, 30, 50, or 100 ppm by weight); and (iv) the cetane improver is present in an amount ranging from 100 ppm to 10000 ppm by weight based on the fuel composition (e.g., at least 100, 200, 500, 800, 1000, or 2000 ppm and/or up to 2000, 3500, 5000, 8000, or 10000 ppm by weight). In various refinements, the weight ratio of the combustible fuel to the fuel additive composition can be at least 2, 3, 5, 10, 15, 20, 25, 50, 100, or 200 and/or up to 5, 7, 8, 10, 15, 20, 25, 30, 40, 50, 60, 80, 100, 200, 500, 800, or 1000. In various embodiments, the weight ratio can range from 2 to 30, 2 to 20, 2 to 10, 2 to 8, 3 to 40, 3 to 25, 3 to 15, 3 to 10, 3 to 7, 5 to 50, 5 to 40, 5 to 30, 5 to 15, 10 to 60, 10 to 30, 15 to 25, 50 to 800, or 200 to 800 depending on the particular combustible fuel and the desired combustion properties for targeted improvement. In another refinement, the cetane number of the fuel composition is at least 50 (e.g., at least 50, 52, or 55 and/or up to 55, 58, or 60; amount of cetane improver is selected to increase the cetane number of the combustible fuel alone to a desired level; cetane number can be determined by known methods such as ASTM D-613 (ISO 5165) for the Cooperative Fuel Research (CFR) engine, D-6890 for the Ignition Quality Tester (IQT), the D-7170 for the Fuel Ignition Tester (FIT) and D-7668 for the Cetane Ignition Delay (CID 510)).

The fuel composition can be generally in liquid form at room temperature (about 25° C.) and preferably at most or all operational environmental temperatures for example as low as about −10° C., −5° C., 0° C. or 5° C. and/or up to about 40° C., such as when the combustible fuel is also in liquid form at such temperatures. In other embodiments, the fuel composition can be in the form of a liquid-coated solid at such temperatures, for example when the combustible fuel is a solid fuel. The fuel additive composition can be formed by any suitable blending or mixing process of its components (e.g., stirring, agitation, high-shear mixing, ultrasonic mixing, etc.), for example by blending an already formed fuel additive composition with the combustible fuel, or by blending individual components of the fuel additive composition directly with the combustible fuel.

Various refinements of the fuel composition are possible. In a refinement, the fuel composition is substantially free from alcohols (e.g., less than 5 wt. %, 2 wt. %, 1 wt. %, 0.1 wt. %, or 0.01 wt. % alcohol based on the fuel composition, for example total alkyl alcohols such as methanol, ethanol, propanol, butanol, isomers thereof, and mixtures thereof). In another refinement, the fuel composition is substantially free from components other than the fuel additive composition and the combustible fuel (e.g., less than 5 wt. %, 2 wt. %, 1 wt. %, 0.1 wt. %, or 0.01 wt. % based on the fuel composition).

Various refinements of the liquid fuel as a combustible fuel in the fuel composition are possible. In a refinement, the liquid fuel comprises a petroleum distillate fuel or oil (e.g., alkane, cycloalkane, and/or aromatic hydrocarbons). In another refinement, the liquid fuel comprises one or more of fuel oil #1 (also including diesel fuel #1 or distillate #1), fuel oil #2 (also including diesel fuel #2, distillate #2, or heating oil), fuel oil #3, fuel oil #4, fuel oil #5, fuel oil #6 (or bunker fuel), kerosene (e.g., including fuel oil #1 or components thereof), jet fuel (e.g., including fuel oil #1 or components thereof), gasoline (e.g., including fuel oil #1 or components thereof), diesel fuel (or petrodiesel; e.g., including fuel oil #2 or components thereof), liquefied natural gas (LNG), and mixtures thereof. In another refinement, the liquid fuel comprises gasoline (e.g., gasoline as the only fuel or in admixture with another fuel). In another refinement, the liquid fuel comprises diesel fuel (e.g., diesel fuel as the only fuel or in admixture with another fuel such as fuel oil #3, fuel oil #4, fuel oil #5, or fuel oil #6). In another refinement, the liquid fuel comprises fuel oil #6 (e.g., fuel oil #6 as the only fuel or in admixture with another fuel). In another refinement, the liquid fuel comprises a biodiesel fuel (e.g., one or more fatty acid alkyl esters such as methyl or ethyl esters). In another refinement, the liquid fuel comprises a jet fuel, which can be a kerosene-type (e.g., having hydrocarbons with a carbon range of about 8 to 16 carbons per molecule) or naphtha-type fuel (e.g., having hydrocarbons with a carbon range of about 5 to 15 carbons per molecule), with or without fuel additives (e.g., one or more of a corrosion inhibitor, lubricant, oxidizing agent, anti-icing agent, etc.). Examples of common jet fuel formulations include Jet A and Jet A-1 (e.g., for civilian aircraft) as well as JP-5 ("jet propellant"), JP-7, and JP-8 (e.g., for military aircraft).

In another aspect, the disclosure relates to a method for burning a fuel composition, the method comprising: burning a fuel composition any of the foregoing aspects, refinements, and embodiments, for example in an engine, generator, or other combustion chamber, whether to provide power in various forms or drive a vehicle or vessel.

Various refinements of the method for burning a fuel composition are possible. In a refinement, the method comprises burning the fuel composition in a vehicle engine (e.g., an internal combustion engine in an automobile or other motor vehicle such as a car, (light) truck, or semi-trailer), for example to provide a motive or driving force to the vehicle. In a further refinement, the combustible fuel can comprise gasoline (e.g., for use in a gasoline-powered vehicle engine). In another further refinement, the combustible fuel can comprise diesel fuel (e.g., for use in a diesel-powered vehicle engine). In another refinement, the method comprises burning the fuel composition in a generator (e.g., a fixed or mobile generator such as for (electrical) power generation, such as not in a vehicle). In a further refinement, the combustible fuel can comprise diesel fuel. In another further refinement, the combustible fuel can comprise one or more of fuel oil #1, fuel oil #2, fuel oil #3, fuel oil #4, fuel oil #5, and fuel oil #6. In another refinement, the method comprises burning the fuel composition in a ship or vessel engine. In a further refinement, the combustible fuel can comprise fuel oil #6.

In another aspect, the disclosure relates to a method for making a fuel composition, the method comprising: mixing a fuel additive composition of any of the foregoing aspects, refinements, and embodiments with a combustible fuel of any of the foregoing aspects, refinements, and embodiments to form the fuel composition; wherein a weight ratio of the combustible fuel to the fuel additive composition ranges from 2 to 1000 (e.g., during the mixing and/or in the final mixed fuel composition). In various refinements, the weight ratio of the combustible fuel to the fuel additive composition can be at least 2, 3, 5, 10, 15, 20, 25, 50, 100, or 200 and/or up to 5, 7, 8, 10, 15, 20, 25, 30, 40, 50, 60, 80, 100, 200, 500, 800, or 1000. In various embodiments, the weight ratio can range from 2 to 30, 2 to 20, 2 to 10, 2 to 8, 3 to 40, 3 to 25, 3 to 15, 3 to 10, 3 to 7, 5 to 50, 5 to 40, 5 to 30, 5 to 15, 10 to 60, 10 to 30, 15 to 25, 50 to 800, or 200 to 800 depending on the particular combustible fuel and the desired combustion properties for targeted improvement.

While the disclosed compositions and methods are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure relates to fuel additive compositions including heavy paraffinic distillates and lighter petroleum distillates, in particular with the heavy paraffinic distillates including a mixture of hydrotreated and/or saturated components and solvent-dewaxed and/or branched components. In some embodiments, the fuel additive compositions further include a combustion catalyst and/or a cetane improver (e.g., such as when intended for addition to a diesel fuel composition). The disclosure further relates to fuel compositions including the fuel additive composition and a liquid or solid combustible fuel. Related methods include methods of making the fuel compositions and methods of burning the fuel compositions. The resulting fuel compositions have several improved combustion properties such as improved combustion efficiency, improved combustion energy/calorie content, reduced sulfur generation, and reduced ash generation.

Hydrotreated heavy paraffinic distillates (e.g., CAS 64742-54-7) can be used in the disclosed fuel additive. The distillates can be formed by treating a petroleum fraction with hydrogen in the presence of a catalyst and they consist of mainly saturated hydrocarbons with carbon numbers of C20 through C50, and the finished oil generally has a viscosity not less than 100 SUS (Seybolt universal second) at 100° F. They typically can contain mostly saturated hydrocarbons after hydrogenation of the petroleum fraction.

Solvent-dewaxed heavy paraffinic distillates (e.g., CAS 64742-65-0) can be used in the disclosed fuel additive. The distillates can be formed by removal of normal paraffins from a petroleum fraction by solvent crystallization and they consist of mainly hydrocarbons with carbon numbers of C20 through C50, and the finished oil generally has a viscosity not less than 100 SUS (Seybolt universal second) at 100° F. They typically can contain branched hydrocarbons remaining after removal of the normal paraffins.

Various suitable petroleum distillates can be used in the disclosed fuel additive composition. Stoddard solvent is a petroleum distillate mixture generally including $C_7$-$C_{12}$ hydrocarbons. The mixture can include three major groups of components: linear and branched alkanes (e.g., paraffins; about 30-50% of the total mixture); cycloalkanes (e.g., cycloparaffins or naphthenes; about 30-40% of the total mixture), and aromatic hydrocarbons (about 10-20% of the total mixture). Stoddard solvent is a refinery blend of differently treated oil fractions. Stoddard solvent typically has a boiling range of 150-200° C. In other embodiments, Stoddard solvent can include $C_5$-$C_{12}$ hydrocarbons and have a boiling range of 185-207° C. White spirits is a suitable petroleum distillate similar to Stoddard solvent with a hydrocarbon range between $C_7$ and $C_{11}$. Naphtha is a suitable petroleum distillate containing predominantly $C_5$-$C_{13}$ aliphatic hydrocarbons and distilling at 30-238° C.

A combustion catalyst generally improves combustion reactions (e.g., as an oxidation catalyst), enhancing decomposition of the combustible fuel in a fuel composition, thereby lowering potential pollutants in the form of unburnt hydrocarbon fuel, soot, $NO_x$ products, etc. Suitable combustion (or oxidation) catalysts include various oxides, for example metal oxides such as those containing cerium (e.g., cerium oxide or ceria), magnesium, aluminum, and/or cobalt. Examples of non-metallic oxidizing combustion catalysts include peroxides such as hydrogen peroxide. The combustion catalyst additionally can exhibit a cleaning effect on an engine's pistons and cylinders (e.g., due to oxidation of residue thereon). Preferably, the combustion catalyst is in a nanoparticle form (e.g., when it is a metal oxide), for example having a size distribution with an average size (e.g., a weight-, volume-, or number-average size such as determined by light scattering or other suitable method) ranging from 2 nm to 50 nm, more generally at least 2, 5, 8, 10, 15, or 20 nm and/or up to 10, 15, 20, 30, 40, or 50 nm, (e.g., 5 nm or 10 nm to 20 nm or 30 nm). The combustion catalyst, in particular when in nanoparticle form, can be provided in the form of a stable, concentrated dispersion of the catalyst in a suitable hydrocarbon medium (e.g., any of the heavy paraffinic distillates and/or lighter petroleum distillates as disclosed herein). The combustion catalyst dispersion can be blended as a as a miscible component with the heavy paraffinic distillates and lighter petroleum distillates in the fuel additive composition and the corresponding fuel composition, resulting in a stable dispersion of the combustion catalyst in the corresponding compositions. Suitable concentrated dispersions of a cerium oxide combustion catalyst are available from NYACOL Nano Technologies, Inc. (Ashland, Mass.).

A cetane improver is generally a chemical which increases a diesel fuel's cetane number as known in the art, for example including nitrates, nitroalkanes, nitrocarbonates and peroxides. A particularly suitable cetane improver is 2-ethylhexyl nitrate (CAS 27247-96-7). The cetane improver is generally a liquid at common usage temperatures, and it can be blended as a miscible component with the heavy paraffinic distillates and lighter petroleum distillates in the fuel additive composition and the corresponding fuel composition. The cetane improver generally has a decomposition temperature lower than that of its corresponding combustible fuel (e.g., blended together in a fuel composition) such that it will begin to decompose or ignite at a relatively lower temperature, which in turn begins ignition of the corresponding combustible fuel (e.g., a particular type of diesel fuel or otherwise). Suitably, the cetane improver is included in the fuel additive composition a level sufficient to increase the cetane number of the fuel composition to at least 50 or 55 (e.g., at least 50, 52, or 55 and/or up to 55, 58, or 60), such as where the combustible fuel alone has a lower cetane number of about 40 to 45 or 50. The cetane number of a composition can be determined by known methods such as ASTM D-613 (ISO 5165) for the Cooperative Fuel Research (CFR) engine, D-6890 for the Ignition Quality Tester (IQT), the D-7170 for the Fuel Ignition Tester (FIT) and D-7668 for the Cetane Ignition Delay (CID 510).

Various embodiments of the disclosed fuel additive compositions, related fuel compositions, and related methods are provided in the following numbered paragraphs.

1. A fuel additive composition comprising: (a) hydrotreated heavy paraffinic distillates present in amount ranging from 10 wt. % to 50 wt. % based on the fuel additive composition; (b) solvent-dewaxed heavy paraffinic distillates present in amount ranging from 10 wt. % to 50 wt. % based on the fuel additive composition; and (c) petroleum distillates comprising hydrocarbons having from 5 to 16 carbon atoms and present in an amount ranging from 10 wt. % to 50 wt. % based on the fuel additive composition.

2. The fuel additive composition of paragraph 1, wherein: (i) the hydrotreated heavy paraffinic distillates are present in amount ranging from 20 wt. % to 40 wt. %; (ii) the solvent-dewaxed heavy paraffinic distillates are present in amount ranging from 25 wt. % to 45 wt. %; and (iii) the petroleum distillates are present in amount ranging from 20 wt. % to 40 wt. %.

3. The fuel additive composition of paragraph 1, wherein: (i) the hydrotreated heavy paraffinic distillates are present in amount ranging from 28 wt. % to 34 wt. %; (ii) the solvent-dewaxed heavy paraffinic distillates are present in amount ranging from 34 wt. % to 40 wt. %; and (iii) the petroleum distillates are present in amount ranging from 29 wt. % to 35 wt. %.

4. A fuel additive composition comprising: (a) saturated heavy paraffinic distillates comprising saturated hydrocarbons having from 20 to 50 carbon atoms or a sub-range thereof and present in amount ranging from 10 wt. % to 50 wt. % based on the fuel additive composition; (b) branched heavy paraffinic distillates comprising branched hydrocarbons having from 20 to 50 carbon atoms or a sub-range thereof and present in amount ranging from 10 wt. % to 50 wt. % based on the fuel additive composition; and (c) petroleum distillates comprising hydrocarbons having from 5 to 16 carbon atoms and present in an amount ranging from 10 wt. % to 50 wt. % based on the fuel additive composition.

5. The fuel additive composition of paragraph 4, wherein: (i) the saturated heavy paraffinic distillates are present in amount ranging from 20 wt. % to 40 wt. %; (ii) the branched heavy paraffinic distillates are present in amount ranging from 25 wt. % to 45 wt. %; and (iii) the petroleum distillates are present in amount ranging from 20 wt. % to 40 wt. %.

6. The fuel additive composition of paragraph 4, wherein: (i) the saturated heavy paraffinic distillates are present in amount ranging from 28 wt. % to 34 wt. %; (ii) the branched heavy paraffinic distillates are present in amount ranging from 34 wt. % to 40 wt. %; and (iii) the petroleum distillates are present in amount ranging from 29 wt. % to 35 wt. %.

7. A fuel additive composition comprising: (a) hydrotreated heavy paraffinic distillates; (b) solvent-dewaxed heavy paraffinic distillates; (c) petroleum distillates comprising hydrocarbons having from 5 to 16 carbon atoms; (d) (optionally) a combustion catalyst; and (e) (optionally) a cetane improver.

8. A fuel additive composition comprising: (a) saturated heavy paraffinic distillates comprising saturated hydrocarbons having from 20 to 50 carbon atoms or a sub-range thereof; (b) branched heavy paraffinic distillates comprising branched hydrocarbons having from 20 to 50 carbon atoms or a sub-range thereof; (c) petroleum distillates comprising hydrocarbons having from 5 to 16 carbon atoms; (d) (optionally) a combustion catalyst; and (e) (optionally) a cetane improver.

9. The fuel additive composition of paragraph 7 or 8, wherein: (i) a weight ratio of the hydrotreated or saturated heavy paraffinic distillates relative to the petroleum distillates ranges from 0.90 to 1.05; and (ii) a weight ratio of the solvent-dewaxed or branched heavy paraffinic distillates relative to the petroleum distillates ranges from 1.00 to 1.30.

10. The fuel additive composition of any of paragraphs 7 to 9, wherein components (a), (b), and (c) are collectively present in a combined amount ranging from 5 wt. % to 40 wt. % based on the fuel additive composition.

11. The fuel additive composition of any of paragraphs 7 to 10, wherein the combustion catalyst is present in an amount ranging from 0.2 wt. % to 5 wt. % based on the fuel additive composition.

12. The fuel additive composition of any of paragraphs 7 to 11, wherein the cetane improver is present in an amount ranging from 30 wt. % to 90 wt. % based on the fuel additive composition.

13. The fuel additive composition of any of paragraphs 7 to 12, wherein a weight ratio of component (e) relative to components (a), (b), and (c) combined ranges from 1 to 8.

14. The fuel additive composition of any of paragraphs 7 to 13, wherein the combustion catalyst comprises cerium oxide.

15. The fuel additive composition of any of paragraphs 7 to 14, wherein the combustion catalyst is in the form of nanoparticles having an average size ranging from 2 nm to 50 nm.

16. The fuel additive composition of any of paragraphs 7 to 15, wherein the cetane improver comprises 2-ethylhexyl nitrate.

17. The fuel additive composition of any of paragraphs 1 to 16, wherein the hydrotreated heavy paraffinic distillates or the saturated heavy paraffinic distillates have a viscosity as measured at 40° C. ranging from 15 cSt to 60 cSt.

18. The fuel additive composition of paragraph 17, wherein the hydrotreated heavy paraffinic distillates or the saturated heavy paraffinic distillates comprises a blend of (i) low-viscosity hydrotreated or saturated heavy paraffinic distillates having a viscosity as measured at 40° C. ranging from 15 cSt to 30 cSt and (ii) high-viscosity hydrotreated or saturated heavy paraffinic distillates having a viscosity as measured at 40° C. ranging from 30 cSt to 60 cSt.

19. The fuel additive composition of any of paragraphs 1 to 18, wherein the hydrotreated heavy paraffinic distillates or the saturated heavy paraffinic distillates have a viscosity as measured at 100° C. ranging from 3 cSt to 10 cSt.

20. The fuel additive composition of any of paragraphs 1 to 19, wherein the hydrotreated heavy paraffinic distillates or the saturated heavy paraffinic distillates have a density ranging from 0.845 kg/L to 0.870 kg/L.

21. The fuel additive composition of any of paragraphs 1 to 20, wherein the solvent-dewaxed heavy paraffinic distillates or the branched heavy paraffinic distillates have a viscosity as measured at 40° C. ranging from 200 cSt to 600 cSt.

22. The fuel additive composition of any of paragraphs 1 to 21, wherein the solvent-dewaxed heavy paraffinic distillates or the branched heavy paraffinic distillates have a viscosity as measured at 100° C. ranging from 15 cSt to 50 cSt.

23. The fuel additive composition of any of paragraphs 1 to 22, wherein the petroleum distillates comprise hydrocarbons having from 7 to 12 carbon atoms.

24. The fuel additive composition of any of paragraphs 1 to 23, wherein the petroleum distillates are selected from the group consisting of mineral spirits, mineral turpentine, petroleum spirits, naphtha, Stoddard solvent, kerosene, and combinations thereof.

25. The fuel additive composition of any of paragraphs 1 to 24, wherein: (i) a weight ratio of the hydrotreated or saturated heavy paraffinic distillates relative to the petroleum distillates ranges from 0.90 to 1.05; and (ii) a weight ratio of the solvent-dewaxed or branched heavy paraffinic distillates relative to the petroleum distillates ranges from 1.00 to 1.30.

26. The fuel additive composition of any of paragraphs 1 to 25, further comprising one or more additives selected from the group consisting of combustion catalysts, antioxidants, antimicrobial agents, anti-static agents, and combinations thereof.

27. The fuel additive composition of any of paragraphs 1 to 26, wherein the fuel additive composition is substantially free from alcohols.

28. The fuel additive composition of any of paragraphs 1 to 27, wherein the fuel additive composition is substantially free from components other than the hydrotreated heavy paraffinic distillates or the saturated heavy paraffinic distillates, the solvent-dewaxed heavy paraffinic distillates or the branched heavy paraffinic distillates, and the petroleum distillates.

29. A fuel composition comprising: (a) the fuel additive composition of any of paragraphs 1 to 28, and (b) a combustible fuel; wherein a weight ratio of the combustible fuel to the fuel additive composition ranges from 2 to 1000.

30. The fuel composition of paragraph 29, wherein the combustible fuel comprises a liquid fuel.

31. The fuel composition of paragraph 30, wherein the liquid fuel comprises a petroleum distillate fuel or oil.

32. The fuel composition of paragraph 30, wherein the liquid fuel comprises one or more of fuel oil #1, fuel oil #2, fuel oil #3, fuel oil #4, fuel oil #5, fuel oil #6, kerosene, jet fuel, gasoline, diesel fuel, liquefied natural gas, and mixtures thereof.

33. The fuel composition of paragraph 30, wherein the liquid fuel comprises gasoline.

34. The fuel composition of paragraph 30, wherein the liquid fuel comprises diesel fuel.

35. The fuel composition of paragraph 30, wherein the liquid fuel comprises fuel oil #6.

36. The fuel composition of paragraph 30, wherein the liquid fuel comprises a biodiesel fuel.

37. The fuel composition of paragraph 29, wherein the combustible fuel comprises a solid fuel.

38. The fuel composition of any of paragraphs 29 to 37, 43, or 44, wherein the fuel composition is substantially free from alcohols.

39. The fuel composition of any of paragraphs 29 to 38, 43, or 44, wherein the fuel composition is substantially free from components other than the fuel additive composition and the combustible fuel.

40. The fuel composition of any of paragraphs 29 to 39, wherein the weight ratio of the combustible fuel to the fuel additive composition ranges from 2 to 20.

41. The fuel composition of any of paragraphs 29 to 40, wherein the weight ratio of the combustible fuel to the fuel additive composition ranges from 3 to 15.

42. The fuel composition of any of paragraphs 29 to 41, wherein the weight ratio of the combustible fuel to the fuel additive composition ranges from 5 to 50.

43. A fuel composition comprising: the fuel additive composition of any of paragraphs 7 to 28; and a combustible fuel; wherein: (i) a weight ratio of the combustible fuel to the fuel additive composition ranges from 2 to 1000; (ii) components (a), (b), and (c) of the fuel additive composition are collectively present in a combined amount ranging from 10 ppm to 5000 ppm by weight based on the fuel composition; (iii) the combustion catalyst is present in an amount ranging from 2 ppm to 100 ppm by weight based on the fuel composition; and (iv) the cetane improver is present in an amount ranging from 100 ppm to 10000 ppm by weight based on the fuel composition.

44. The fuel composition of paragraph 43, wherein the cetane number of the fuel composition is at least 50.

45. A method for burning a fuel composition, the method comprising: burning a fuel composition according to any of paragraphs 29 to 44.

46. The method of paragraph 45, comprising burning the fuel composition in a vehicle engine.

47. The method of paragraph 46, wherein the combustible fuel comprises gasoline.

48. The method of paragraph 46, wherein the combustible fuel comprises diesel fuel.

49. The method of paragraph 45, comprising burning the fuel composition in a generator.

50. The method of paragraph 49, wherein the combustible fuel comprises diesel fuel.

51. The method of paragraph 49, wherein the combustible fuel comprises one or more of fuel oil #1, fuel oil #2, fuel oil #3, fuel oil #4, fuel oil #5, and fuel oil #6.

52. The method of paragraph 45, comprising burning the fuel composition in a ship engine.

53. The method of paragraph 52, wherein the combustible fuel comprises fuel oil #6.

54. A method for making a fuel composition, the method comprising: mixing a fuel additive composition of any of paragraphs 1 to 28 with a combustible fuel to form the fuel composition; wherein a weight ratio of the combustible fuel to the fuel additive composition ranges from 2 to 1000.

EXAMPLES

The following examples illustrate the disclosed fuel additive compositions, but are not intended to limit the scope of any claims thereto.

In Examples 1-3, fuel additive compositions were prepared and burned either alone or in combination with a crushed powder basin coal (i.e., a solid fuel composition). Example 1 was prepared by mixing (i) 60 wt. % hydrotreated heavy paraffinic distillates (CAS 64742-54-7; available as CHEVRON 100N, a blend of neutral oil 100C and neutral oil 220C from Chevron USA), (ii) 8.0 wt. % solvent-dewaxed heavy paraffinic distillates (CAS 64742-65-0; available as CALPAR 2500 from Calumet Shreveport Lubricants and Waxes), and (iii) 32.0 wt. % petroleum distillates in the form of Stoddard solvent (CAS 64742-88-7; available from Fisher Scientific). Example 2 was prepared in same way as Example 1, but instead contained (i) 31.2 wt. % hydrotreated heavy paraffinic distillates, (ii) 36.8 wt. % solvent-dewaxed heavy paraffinic distillates, and (iii) 32.0 wt. % petroleum distillates in the form of Stoddard solvent. Example 3 was a commercially available comparative fuel additive composition.

The example formulations were burned either alone or in combination with coal and measured for moisture content (wt. %; ASTM D2961/D3173), ash content (wt. %; ASTM D3174), sulfur content (ASTM D4239), BTU content (BTU/lb; ASTM D5865), volatile matter (wt. %, ASTM D3175), and fixed carbon content (wt. %). Results for burning of the example formulations or coal alone are summarized in Table 1 on an as-received basis, a dry basis, and a MAF-basis (BTU only; moisture and ash free basis). Results for burning of the example formulations in combination with coal are summarized in Table 2 on an as-received basis, a dry basis, and a MAF-basis (BTU only; moisture and ash free basis). For the burn tests with coal, the example formulations were blended with coal in weight ratios of either 1 or 2 parts fuel additive composition to 10 parts of coal.

TABLE 1

Burn Data for Fuel Additive Formulations

| Parameter | As Rec'd | Dry | MAF |
|---|---|---|---|
| Example 1 | | | |
| Moisture | 0.01 | | |
| Ash | 0.01 | 0.01 | |
| Sulfur | 0.64 | 0.64 | |
| BTU | 19,856 | 19,858 | 19,860 |
| Volatile Matter | 99.95 | 99.96 | |
| Fixed Carbon | 0.03 | 0.03 | |
| Example 2 | | | |
| Moisture | 0.01 | | |
| Ash | 0.01 | 0.01 | |
| Sulfur | 0.35 | 0.35 | |
| BTU | 19,776 | 19,777 | 19,779 |
| Volatile Matter | 99.95 | 99.96 | |
| Fixed Carbon | 0.03 | 0.03 | |
| Example 3 | | | |
| Moisture | 0.03 | | |
| Ash | 0.03 | 0.03 | |
| Sulfur | 0.05 | 0.05 | |
| BTU | 19,662 | 19,668 | 19,647 |
| Volatile Matter | 0 | 0 | |
| Fixed Carbon | 0 | 0 | |
| Coal Sample 1 | | | |
| Moisture | 5.02 | | |
| Ash | 18.27 | 19.23 | |
| Sulfur | 1.77 | 1.86 | |
| BTU | 11,418 | 12,021 | 14,884 |
| Volatile Matter | 31.23 | 32.88 | |
| Fixed Carbon | 45.48 | 47.89 | |
| Coal Sample 2 | | | |
| Moisture | 4.15 | | |
| Ash | 13.35 | 13.93 | |
| Sulfur | 3.32 | 3.47 | |
| BTU | 12,191 | 12,719 | 14,777 |
| Volatile Matter | 34.74 | 36.25 | |
| Fixed Carbon | 47.75 | 49.82 | |

TABLE 2

Burn Data for Fuel Additive Formulations with Coal

| | Coal alone | | | Coal w/Fuel Additive (change after treatment) | | | Coal w/Fuel Additive (percent change) | | |
|---|---|---|---|---|---|---|---|---|---|
| Parameter | As Rec'd | Dry | MAF | As Rec'd | Dry | MAF | As Rec'd | Dry | MAF |
| Example 1 (1 part) and Coal (10 parts) | | | | | | | | | |
| Moisture | 3.96 | | | −0.19 | | | −4.58% | | |
| Ash | 12.19 | 12.69 | | −1.16 | −1.24 | | −8.69% | −8.90% | |
| Sulfur | 2.9 | 3.02 | | −0.42 | −0.45 | | −12.65% | −12.97% | |
| BTU | 12,941 | 13,475 | 15,434 | 750 | 756 | 657 | 6.15% | 5.94% | 4.45% |
| Volatile Matter | 41.25 | 42.95 | | 6.51 | 6.70 | | 18.74% | 18.48% | |
| Fixed Carbon | 42.6 | 44.36 | | −5.15 | −5.46 | | −10.79% | −10.96% | |
| Example 1 (2 parts) and Coal (10 parts) | | | | | | | | | |
| Moisture | 5.08 | | | 0.93 | | | 22.41% | | |
| Ash | 11.72 | 12.35 | | −1.63 | −1.58 | | −12.21% | −11.34% | |
| Sulfur | 2.82 | 2.97 | | −0.50 | −0.50 | | −15.06% | −14.41% | |
| BTU | 13,249 | 13,958 | 15,925 | 1058 | 1239 | 1148 | 8.68% | 9.74% | 7.77% |
| Volatile Matter | 42.17 | 44.43 | | 7.43 | 8.18 | | 21.39% | 22.57% | |
| Fixed Carbon | 41.03 | 43.22 | | −6.72 | −6.60 | | −14.07% | −13.25% | |
| Example 2 (1 part) and Coal (10 parts) | | | | | | | | | |
| Moisture | 5.17 | | | 1.02 | | | 24.58% | | |
| Ash | 11.7 | 12.34 | | −1.65 | −1.59 | | −12.36% | −11.41% | |
| Sulfur | 2.83 | 2.98 | | −0.49 | −0.49 | | −14.76% | −14.12% | |
| BTU | 13,229 | 13,950 | 15,913 | 1038 | 1231 | 1136 | 8.51% | 9.68% | 7.69% |
| Volatile Matter | 42.31 | 44.62 | | 7.57 | 8.37 | | 21.79% | 23.09% | |
| Fixed Carbon | 40.82 | 43.05 | | −6.93 | −6.77 | | −14.51% | −13.59% | |
| Example 2 (2 parts) and Coal (10 parts) | | | | | | | | | |
| Moisture | 3.62 | | | −0.53 | | | −12.77% | | |
| Ash | 12.36 | 12.82 | | −0.99 | −1.11 | | −7.42% | −7.97% | |

TABLE 2-continued

Burn Data for Fuel Additive Formulations with Coal

| | Coal alone | | | Coal w/Fuel Additive (change after treatment) | | | Coal w/Fuel Additive (percent change) | | |
|---|---|---|---|---|---|---|---|---|---|
| Parameter | As Rec'd | Dry | MAF | As Rec'd | Dry | MAF | As Rec'd | Dry | MAF |
| Sulfur | 3.03 | 3.14 | | −0.29 | −0.33 | | −8.73% | −9.51% | |
| BTU | 12,933 | 13,419 | 15,393 | 742 | 700 | 616 | 6.09% | 5.50% | 4.17% |
| Volatile Matter | 40.41 | 41.93 | | 5.67 | 5.68 | | 16.32% | 15.67% | |
| Fixed Carbon | 43.61 | 45.25 | | −4.14 | −4.57 | | −8.67% | −9.17% | |
| Example 3 (1 part) and Coal (10 parts) | | | | | | | | | |
| Moisture | 1.17 | | | −3.85 | | | −76.69% | | |
| Ash | 16.97 | 17.17 | | −1.30 | −2.06 | | −7.12% | −10.71% | |
| Sulfur | 2.64 | 2.67 | | 0.87 | 0.81 | | 49.15% | 43.55% | |
| BTU | 12,692 | 12,842 | 15,504 | 1274 | 821 | 620 | 11.16% | 6.83% | 4.17% |
| Volatile Matter | 38.9 | 39.36 | | 7.67 | 6.48 | | 24.56% | 19.71% | |
| Fixed Carbon | 42.96 | 43.47 | | −2.52 | −4.42 | | −5.54% | −9.23% | |
| Example 3 (2 parts) and Coal (10 parts) | | | | | | | | | |
| Moisture | 1.19 | | | −3.83 | | | −76.29% | | |
| Ash | 15.66 | 15.85 | | −2.61 | −3.38 | | −14.29% | −17.58% | |
| Sulfur | 2.62 | 2.65 | | 0.85 | 0.79 | | 48.02% | 42.47% | |
| BTU | 13,166 | 13,325 | 15,835 | 1748 | 1304 | 951 | 15.31% | 10.85% | 6.39% |
| Volatile Matter | 48.88 | 44.41 | | 17.65 | 11.53 | | 56.52% | 35.07% | |
| Fixed Carbon | 39.26 | 39.74 | | −6.22 | −8.15 | | −13.68% | −17.02% | |

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

What is claimed is:

1. A fuel additive composition comprising:

(a) saturated heavy paraffinic distillates comprising saturated hydrocarbons having from 20 to 50 carbon atoms or a sub-range thereof, wherein the saturated heavy paraffinic distillates have a viscosity as measured at 40° C. in a range from 15 cSt to 60 cSt;

(b) branched heavy paraffinic distillates comprising branched hydrocarbons having from 20 to 50 carbon atoms or a sub-range thereof, wherein the branched heavy paraffinic distillates have a viscosity as measured at 40° C. in a range from 200 cSt to 600 cSt;

(c) petroleum distillates comprising hydrocarbons having from 5 to 16 carbon atoms;

(d) a combustion catalyst comprising a metal oxide; and (e) a cetane improver selected from the group consisting of a nitrate, a nitroalkane, a nitrocarbonate and a peroxide.

2. The fuel additive composition of claim 1, wherein:

(i) a weight ratio of the saturated heavy paraffinic distillates relative to the petroleum distillates ranges from 0.90 to 1.05; and (ii) a weight ratio of the branched heavy paraffinic distillates relative to the petroleum distillates ranges from 1.00 to 1.30.

3. The fuel additive composition of claim 1, wherein components (a), (b), and (c) are collectively present in a combined amount ranging from 5 wt. % to 40 wt. % based on the fuel additive composition.

4. The fuel additive composition of claim 1, wherein the combustion catalyst is present in an amount ranging from 0.2 wt. % to 5 wt. % based on the fuel additive composition.

5. The fuel additive composition of claim 1, wherein the cetane improver is present in an amount ranging from 30 wt. % to 90 wt. % based on the fuel additive composition.

6. The fuel additive composition of claim 1, wherein a weight ratio of component (e) relative to components (a), (b), and (c) combined ranges from 1 to 8.

7. The fuel additive composition of claim 1, wherein the combustion catalyst comprises cerium oxide.

8. The fuel additive composition of claim 1, wherein the combustion catalyst is in the form of nanoparticles having an average size ranging from 2 nm to 50 nm.

9. The fuel additive composition of claim 1, wherein the cetane improver comprises 2-ethylhexyl nitrate.

10. A fuel composition comprising:

(a) the fuel additive composition of claim 6; and (b) a combustible fuel;

wherein a weight ratio of the combustible fuel to the fuel additive composition ranges from 2 to 1000.

11. The fuel composition of claim 10, wherein the liquid fuel comprises one or more of fuel oil #1, fuel oil #2, fuel oil #3, fuel oil #4, fuel oil #5, fuel oil #6, kerosene, jet fuel, gasoline, diesel fuel, biodiesel fuel, liquefied natural gas, and mixtures thereof.

12. A method for burning a fuel composition, the method comprising:

burning a fuel composition according to claim 10.

13. A fuel composition comprising:

the fuel additive composition of claim 1; and a combustible fuel;

wherein:

(i) a weight ratio of the combustible fuel to the fuel additive composition ranges from 2 to 1000;

(ii) components (a), (b), and (c) of the fuel additive composition are collectively present in a combined amount ranging from 10 ppm to 5000 ppm by weight based on the fuel composition;

(iii) the combustion catalyst is present in an amount ranging from 2 ppm to 100 ppm by weight based on the fuel composition; and (iv) the cetane improver is present in an amount ranging from 100 ppm to 10000 ppm by weight based on the fuel composition.

14. The fuel composition of claim 13, wherein the cetane number of the fuel composition is at least 50.

15. A method for making a fuel composition, the method comprising:

mixing a fuel additive composition of claim 1 with a combustible fuel to form the fuel composition;

wherein a weight ratio of the combustible fuel to the fuel additive composition ranges from 2 to 1000.

16. The fuel additive composition of claim 1, wherein:

a weight ratio of the saturated heavy paraffinic distillates relative to the petroleum distillates ranges from 0.90 to 1.05;

a weight ratio of the branched heavy paraffinic distillates relative to the petroleum distillates ranges from 1.00 to 1.30;

components (a), (b), and (c) are collectively present in a combined amount ranging from 5 wt. % to 40 wt. % based on the fuel additive composition;

the combustion catalyst is present in an amount ranging from 0.2 wt. % to 5 wt. % based on the fuel additive composition;

the cetane improver is present in an amount ranging from 30 wt. % to 90 wt. % based on the fuel additive composition; and a weight ratio of component (e) relative to components (a), (b), and (c) combined ranges from 1 to 8.

* * * * *